United States Patent [19]

Mendez

[11] Patent Number: 4,651,492

[45] Date of Patent: Mar. 24, 1987

[54] ROOF TILE

[76] Inventor: Fernando Mendez, 10370 NW. 135 St., Hialeah Gardens, Fla. 33016

[21] Appl. No.: 866,835

[22] Filed: May 27, 1986

Related U.S. Application Data

[63] Continuation-in-part of Ser. No. 754,608, Jul. 12, 1985, Pat. No. 4,606,164.

[51] Int. Cl.[4] ..... E04D 1/04

[52] U.S. Cl. ..... 52/536; 52/588; 52/595

[58] Field of Search ..... 52/536, 533, 588, 595, 52/539

[56] References Cited

U.S. PATENT DOCUMENTS

| | | | |
|---|---|---|---|
| 152,991 | 7/1874 | Hamel | 52/536 |
| 522,686 | 7/1894 | Donaldson | 52/536 |
| 953,939 | 4/1910 | Arnold et al. | 52/536 |
| 3,434,260 | 3/1969 | Carter | 52/533 X |
| 3,740,914 | 6/1973 | Diez | 52/536 X |
| 3,843,383 | 11/1974 | Wilson et al. | 52/533 |
| 4,574,536 | 3/1986 | Bamber et al. | 52/536 X |
| 4,606,164 | 8/1986 | Mendez | 52/536 |

*Primary Examiner*—J. Karl Bell

*Attorney, Agent, or Firm*—Jesus Sanchelima

[57] ABSTRACT

A roof tile that has a top upper rectangular flat member and a wedged honeycomb frame integrally built on its underside. Grooves are formed on the underside of the top rectangular member and substantially adjacent to the lateral sides of the top rectangular flat member. A cooperating gutter member is positioned below the interface of horizontally abutting tiles to collect the water that goes through the interface opening and to discharge it over the vertically abutting roof tile in front.

4 Claims, 6 Drawing Figures

ROOF TILE

FIELD OF THE INVENTION

The present invention is a continuation-in-part of U.S. patent application Ser. No. 754,608, filed on July 12, 1985 now U.S. Pat. No. 4,606,164, and it is hereby incorporated by reference.

BACKGROUND OF THE INVENTION

1. Other Related Applications.

The present invention relates to roof tiles.

2. Description of the Related Art.

The problem of cracked roof tiles, specially, when roofers walk on them is often traced to the lack of support resulting from partially overlapping of adjacent roof tiles. The parent application solved that problem by providing a honeycomb frame that has substantially a wedge shape. The interlocking features in that tile, however, were not suitable for currently known production molds.

Applicant believes that the closest reference corresponds to U.S. Pat. No. 522,686 issued to John E. Donaldson in 1984. However, it differs from the present invention because it did not achieve any material cost savings with its wedge-shape underside. Donaldson's tile is a solid piece and is, consequently, bulky and heavy. The small grooves C carved in on the extensions of the tile do not effectively route the water down if the rain is substantial.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a roof tile that is well rested on the roof sheathing and withstands the weight of persons walking over it.

It is another object of this invention to provide a tile that can be manufactured in high production molds with favorable yield.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
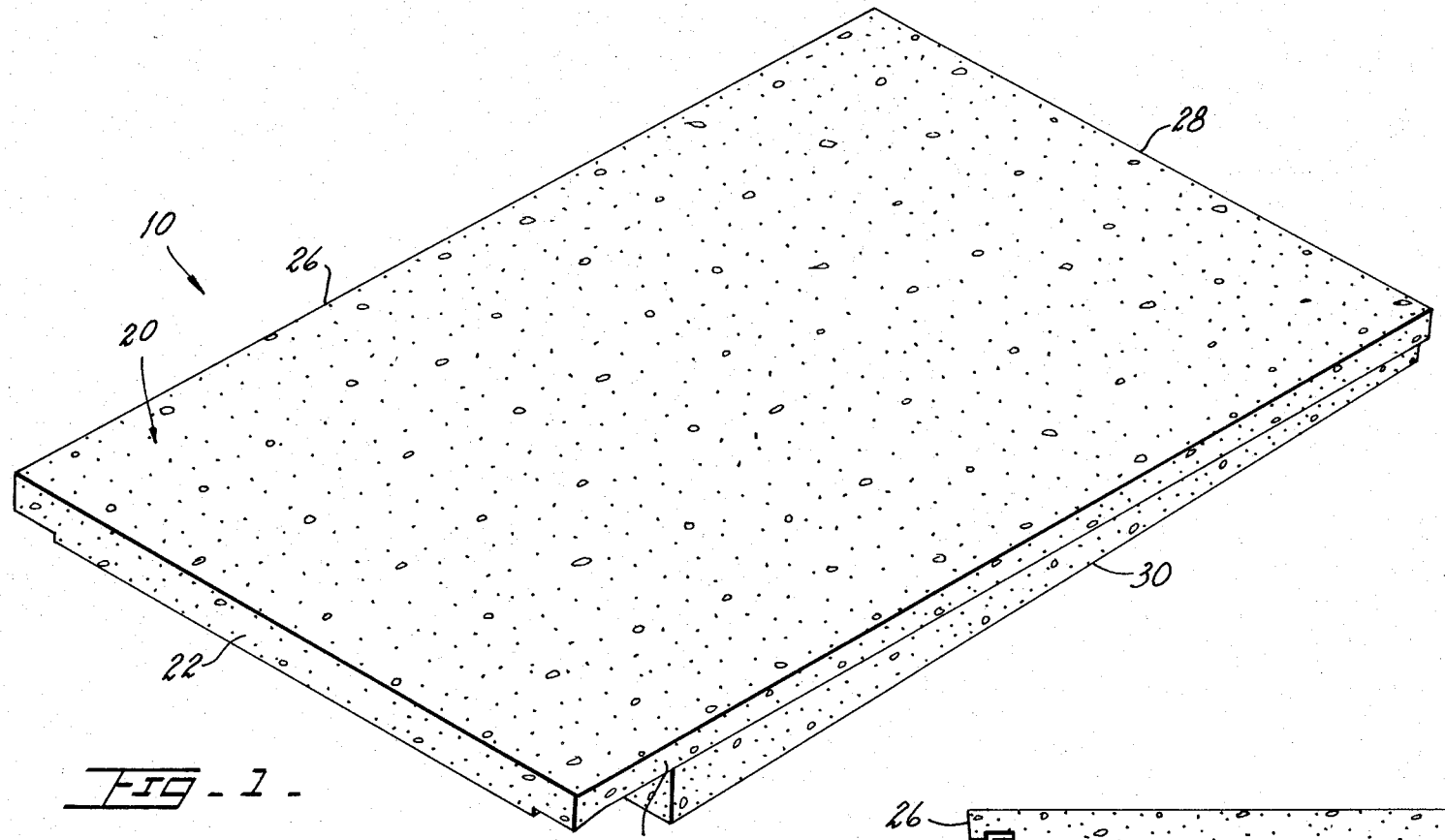
FIG. 1 represents a top view in perspective of the roof tile subject of the present application.
Figure 2:
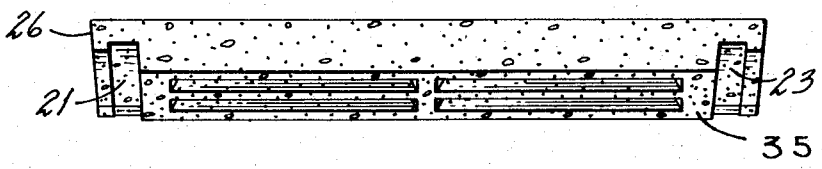
FIG. 2 shows an end view of the roof tile and also showing the bottom of the roof tile.
Figure 5:
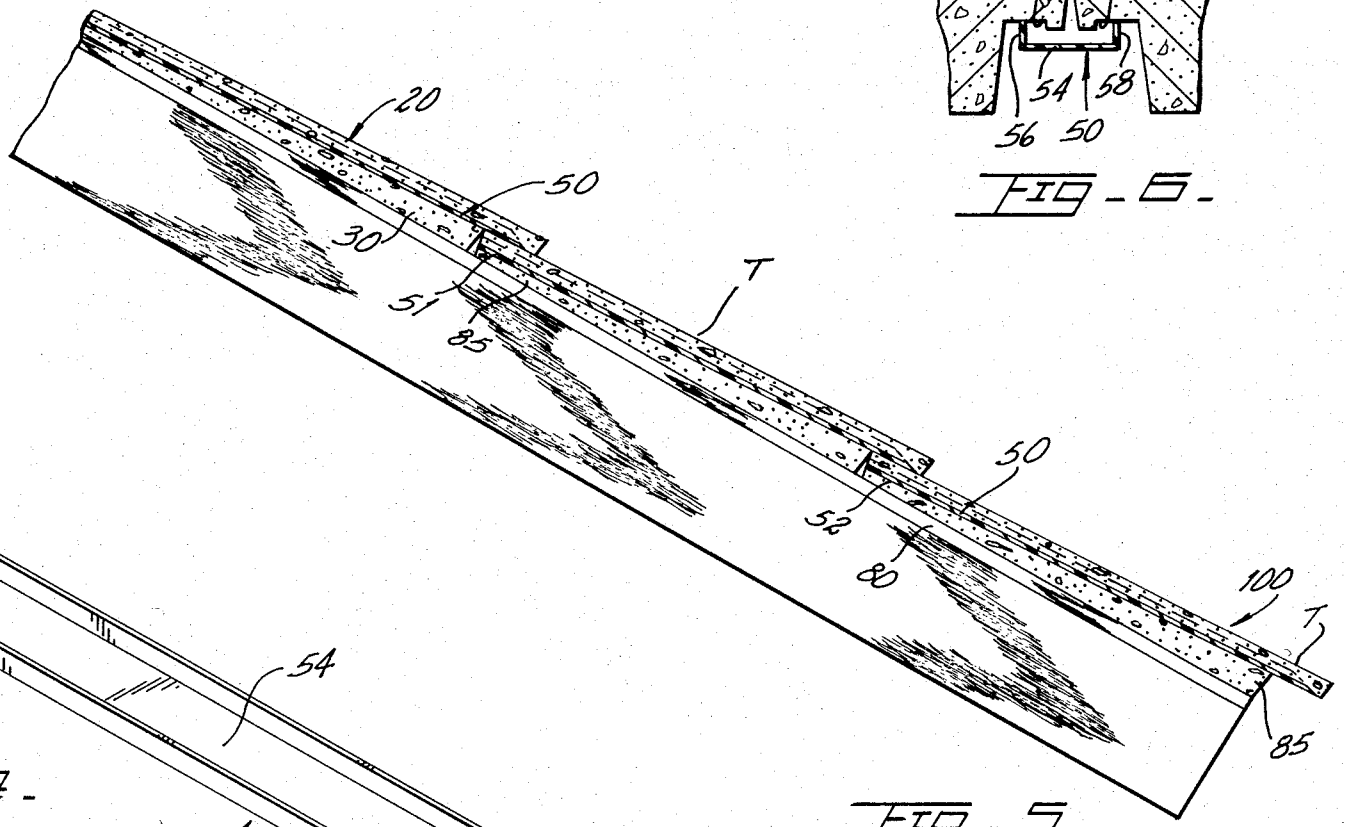
FIG. 5 is a cross-section of several vertically abutting roof tiles, partially overlapping on their ends.

Referring now to FIG. 1, where the present invention generally referred to with numeral 10, it can be seen that the roof tile has substantially a flat rectangular shape and it is basically composed of upper or top rectangular member 20 and wedge frame member 30 integrally built on the underside of member 20. Upper rectangular member 20 has front wall 22, right wall 24, left wall 26 and rear wall 28. Longitudinal grooves 21 and 23 extend close to left and right walls 24 and 26, as shown in FIG. 2, on the underside of upper rectangular member 20. As in the parent application, frame member 30 has a honeycomb appearance which is intended to keep the cost and weight of the tile low while providing the necessary strength, as seen in FIG. 2. The lower surface 35 of frame member 30 provides adequate resting area that comes in contact with roof sheathing 80, as seen in FIGS. 2 and 5.

Figure 3:
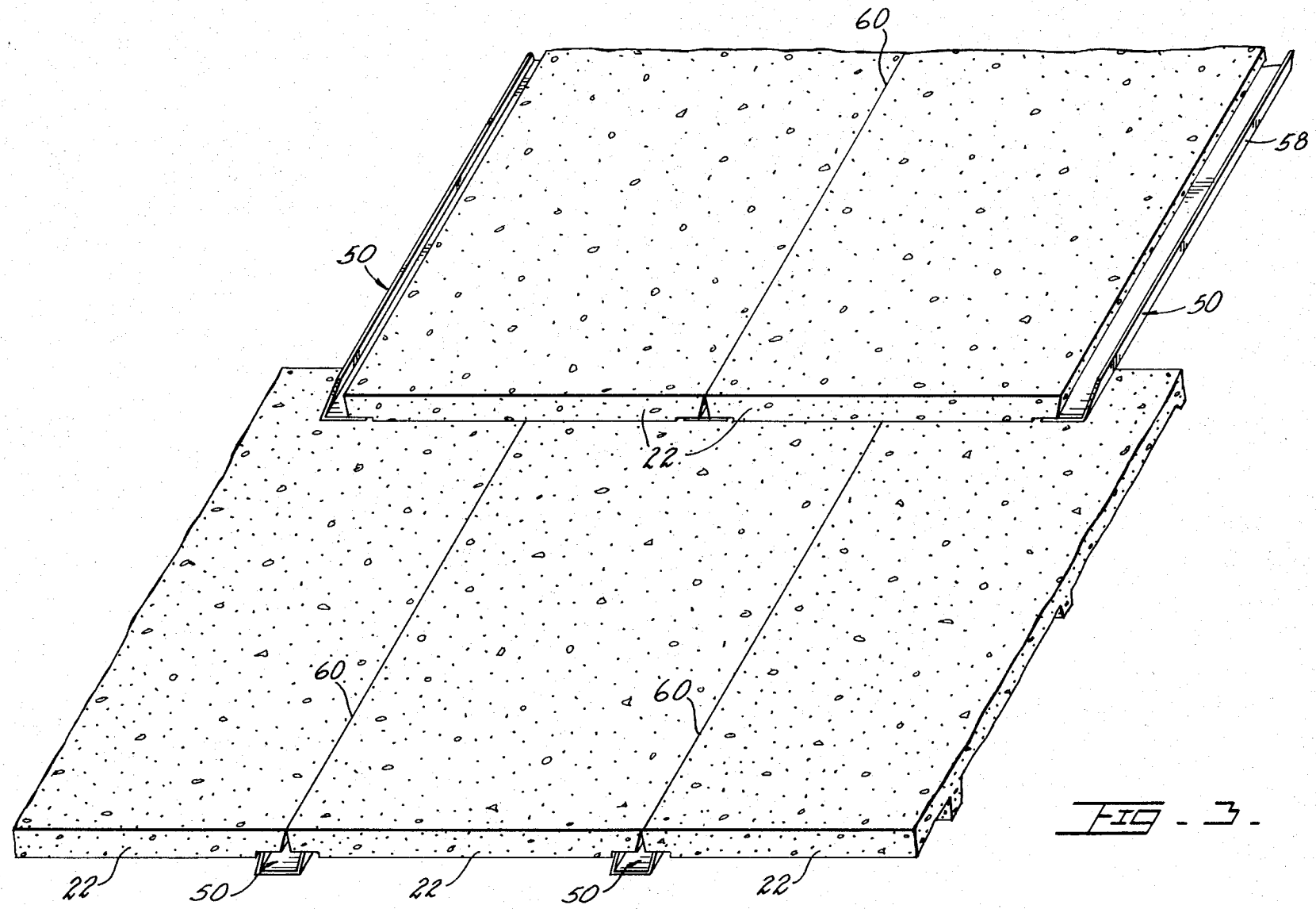
FIG. 3 illustrates several adjacent roof tiles as they would look when properly installed on a roof.
Figure 6:
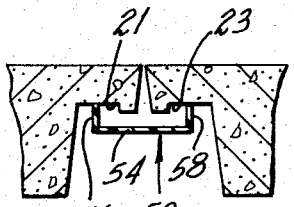
FIG. 6 illustrates the gutter member installed at the joint of the abutting titles.

In FIG. 3, sections of two rows of horizontally abutting roof tiles T are shown. It can be observed that a gutter member 50 is positioned below the interface openings 60 of the horizontally abutting tiles. The water that goes through openings 60 is collected by gutter member 50 and discharged over the vertically abutting tile in front. End 52 of gutter member 50 rests on the rear upper surface of the tile that is vertically abutting in front, as shown in FIG. 5. End 51 of gutter member 50 extends the longitudinal length of the tile to the front of frame member 30 of the vertically abutting tile behind. There is a clearance 85 between the underside of bottom member 54 of gutter member 50 of the frontmost tile T and roof sheathing 80 that is filled with plaster or cement. Therefore, end 51 extends rearwardly keeping the same position of walls 56 and 58 inside grooves 21 and 23, as seen in FIG. 6.

Figure 4:
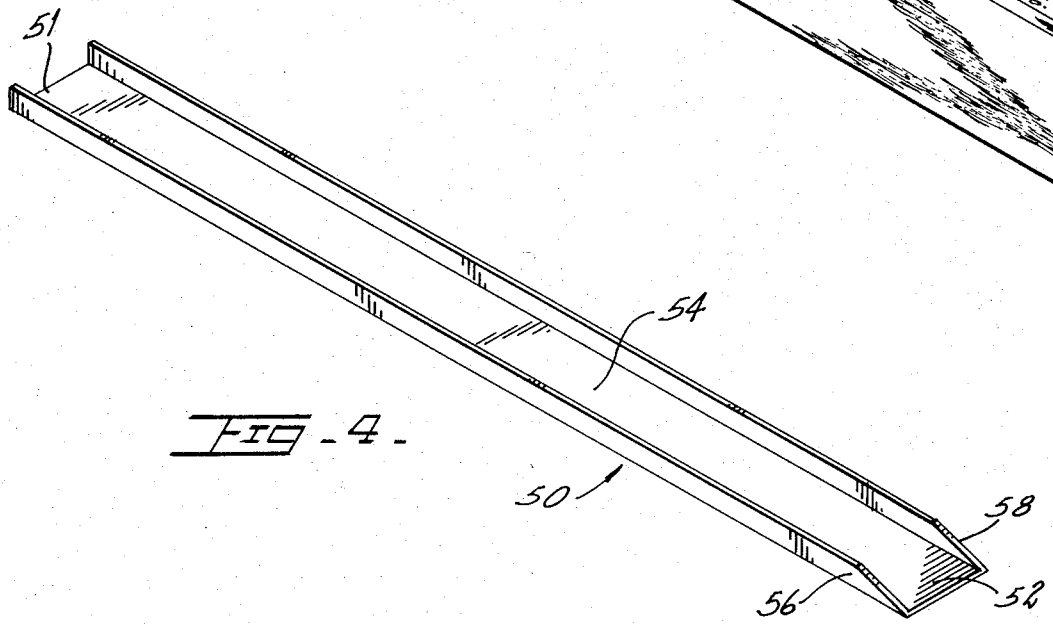
FIG. 4 is a representation of the gutter member used between horizontally abutting tiles.

FIG. 4 shows gutter member 50 which is preferably made out of a light plastic material that is not susceptible to the elements. Walls 56 and 58 extend upwardly from bottom member 54 in gutter member 50. Walls 56 and 58 enter inside longitudinal grooves 21 or 23.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. A roof tile to be contiguously arranged in horizontal and vertical rows, comprising:

A. a substantially rectangular top member having an upper side, an underside, front, rear, left and right walls, and including parallel to and substantially close to said right and left walls two longitudinally extending grooves formed on said underside and further including two longitudinal rib members extending parallel to said groove and being located between said grooves and said left and right walls;

B. a substantially rectangular frame member attached to the underside of said top member having longitudinal and lateral reinforcement members within said frame member and defining at least four cavities, said frame structure being adjacent to said rear wall and having a smaller longitudinal length and width than said top member so that an interlocking cavity is formed with the front portion of the underside of said top member and said frame thereby allowing the housing of a portion of the rear part of a longitudinally contiguous tile within said interlocking cavity; and C. longitudinal gutter means having a flat bottom and upwardly extending side walls that cooperate with said longitudinal grooves and said walls being substantially housed therein so that when said roof tile is horizontally abutting with a similar tile said gutter means is positioned below the interface opening of the tiles.

2. The roof tile set forth in claim 1 wherein said frame member has a wedge like elevational shape thereby increasing the depth of said frame member towards the front of said tile.

3. The roof tile set forth in claim 1 wherein said gutter means includes a front end and a rear end and said gutter means extends the entire length of said tile so that said front end rests on the upper surface of the top member of a vertically contiguous tile in front of said gutter means.

4. The roof tile set forth in claim 3 wherein said gutter means is made out of a plastic material.

* * * * *